US006772996B1

(12) United States Patent
Carlson et al.

(10) Patent No.: US 6,772,996 B1
(45) Date of Patent: Aug. 10, 2004

(54) DOUBLE ENDED STAPLE REMOVER/ PLIERS

(76) Inventors: Donald G. Carlson, 133 Sycamore Valley Rd., Chico, CA (US) 95973; Lynn Smith, 199 Sycamore Valley Rd., Chico, CA (US) 95973

( * ) Notice: Subject to any disclaimer, the term of this patent is extended or adjusted under 35 U.S.C. 154(b) by 0 days.

(21) Appl. No.: 10/655,868

(22) Filed: Sep. 5, 2003

(51) Int. Cl.[7] ..... B25C 11/00
(52) U.S. Cl. ..... 254/28
(58) Field of Search ..... 254/28, 18; 7/125, 7/165, 166

(56) References Cited

U.S. PATENT DOCUMENTS 3,143,800 A * 8/1964 Vizzi ..... 30/261
4,776,567 A * 10/1988 Strickland ..... 254/1
5,090,662 A * 2/1992 Koo ..... 254/28

* cited by examiner

*Primary Examiner*—Lee Wilson
(74) *Attorney, Agent, or Firm*—Donald W. Meeker

(57) ABSTRACT

A staple remover with two ends, a first that is a standard staple remover and a second end that acts as a pair of pliers to grip and extract a partially removed staple.

4 Claims, 2 Drawing Sheets

DOUBLE ENDED STAPLE REMOVER/ PLIERS

BACKGROUND OF THE INVENTION

1. Field of the Invention

The present invention relates to staple removers that have an added device for complete removal of a staple from an object or paper and more particularly, to an improved staple remover which has two ends, a first that is a standard staple remover and a second end that acts as a pair of pliers to grip and extract a partially removed staple.

2. Description of the Prior Art

The disadvantage of the conventional staple remover is that, frequently, one leg of the staple is dislodged, while the other leg remains embedded in the object or paper. When this occurs, the usual procedure employed is to grasp the staple with the fingers and to pull it free from the object. Finger punctures, torn fingernails, and torn paper are often the result of this effort. Prior art patents do not adequately address this problem in an efficient and effective way.

U.S. Pat. No. 5,090,662, issued Feb. 25, 1992 to Koo, describes a staple remover that has nippers formed on a side of its pivot opposite the staple removing jaws for gripping a staple bar. The nippers are formed by crossbars that connect to the opposite flanges of the body members, which form the staple remover.

U.S. Pat. No. 5,292,106, issued Mar. 8, 1994 to Li, concerns a staple remover wherein a pair of pointed teeth engage with a second pair of teeth to remove a staple, which has an improvement of a pair of clamping plates at the opposite end thereof.

U.S. Pat. No. 4,784,370, issued Nov. 15, 1988 to Strickland, discloses a staple removing device and associated method employing unique clamping devices for the removal of a staple that is broken or partially inserted in an object. The clamping devices are provided to engage the whole or parts of a partially removed staple thereby allowing the staple to be pulled from the object in accordance with the associated method.

U.S. Pat. No. 4,776,567, issued Oct. 11, 1988 to Strickland, illustrates a staple removing device and associated method employing unique clamping devices for the removal of a staple that is broken or partially inserted in an object. The clamping devices are provided to engage the whole or parts of a partially removed staple thereby allowing the staple to be pulled from the object in accordance with the associated method.

U.S. Pat. No. 2,033,050, issued Mar. 3, 1936 to Pankonin, shows a tool for removing staples or similar fasteners from paper. The tool has a pair of opposing jaws with at least one that has a camming action. The tool has handles that are on the opposite end from the jaws, which when squeezed together cause the to jaws to move towards each other thereby gripping the staple. The jaws have wedging elements for prying a staple away from a stapled article.

U.S. Pat. No. 5,875,503, issued Mar. 2, 1999 to Cheldin, provides a staple remover with first and second jaws pivotally connected for rotation about a single axis, which has wedging elements for prying a staple away from a stapled article. The remover may include gripping elements for grasping a partially disengaged or sheared staple. A letter opening is provided on one of the jaws for insertion into an envelope and slitting the same for opening the envelope.

U.S. Pat. No. 4,921,216, issued May 1, 1990 to Krulich, shows a staple remover for removing staples from stapled materials, which utilizes an inclined plane in combination with a gripper. First and second jaws are provided, each have two jaw members. The two jaw members of the first jaw are spaced from each other just less than the width of a staple. The two jaw members of the second jaw are spaced from each other less than the spacing of the jaw members for the first jaw so that the second jaw may insert within the first jaw. The first and second jaws are connected together by a pivot and are resiliently biased in an open position. Each of the jaw members of the first and second jaws terminate in a pointed extremity. Each of the jaw members of the first and second jaws further have an upper and lower cam surface which smoothly diverge from each other rearwardly from the pointed extremity. The combination of the upper and lower cams of each jaw member form two parallel wedge shapes which are used as dual inclined planes to cause a staple to be separated from materials to which it is stapled. The jaw members of one of the jaws are each provided with a notch spaced from the aforesaid pointed extremity thereof. A staple is removed by squeezing the jaws together thereby forcing the pointed extremities to move under the staple, the inclined plane action of the upper and lower cams causing the staple to be partially released from the material to which it is stapled. Thereupon, the staple will encounter the aforesaid notches, causing the staple to be gripped by action of the cam surface of the non-notched jaw members of the other jaw, and allowing for final staple removal by pulling.

U.S. Pat. No. 5,284,322, issued Feb. 8, 1994 to Clark, claims a staple puller with cam surfaces for pulling a staple from an object that has gripping surfaces at the upper ends of the cam surfaces to allow the staple being pulled to be securely gripped after the pulling action of the cam surfaces has ceased. A release slot is provided adjacent the gripping surfaces to receive a previously pulled staple such that it does not interfere with the pulling or gripping of a staple being pulled.

U.S. Pat. No. 6,145,811, issued Nov. 14, 2000 to Cheldin, puts forth an apparatus for removing staples that includes first and second jaws pivotally connected at their first ends, and first and second wedging elements connected to second ends of the jaws. First and second platforms are attached to the respective first and second jaws. Each platform has a planar pressing surface and a planar pressing stub extending laterally from opposing sides of the platform, such that the planar surfaces and the stubs of the first and second platforms generally face one another. The jaws include notches formed on an inner edges thereof for the grasping of staples. The apparatus further includes first and second gripping elements attached to and extending laterally from the first and second jaws so as to face one another for the removal of difficult-to-remove staples.

U.S. Pat. No. 5,354,033, issued Oct. 11, 1994 to Cheldin, indicates a staple remover with first and second jaws, which are pivotally connected for rotation about a single axis. The first and second jaws have wedging elements for prying a staple away from a stapled article, gripping elements for grasping opposing sides of a partially disengaged or sheared staple, at least one wire engaging edge for cutting wire and arms to provide the operator with increased leverage.

U.S. Pat. No. 5,513,833, issued May 7, 1996 to Kirk, is for a device for removing a U-shaped staple pin of the type that has opposing arms driven into a surface that includes, in part, a grip portion and a lower and upper jaw pivotally mounted within said grip portion. The lower and upper jaw each include a base portion and integrally formed sides. The lower jaw cooperates with the upper jaw for movably engaging and upwardly displacing the driven staple pin from the surface. A rigid tongue member is affixed to the base and between the sides of the lower jaw. The rigid member forcibly bends the displaced staple pin substantially in half as the lower and upper jaws move the displaced staple pin into contact with the rigid member. Such forcible bending of the staple pin further causes the arms of the pin to rotate outwardly and uniformly disengage from the surface. A resilient member mounted on the base and between the sides of the upper jaw ejects the disengaged staple pin from the staple remover.

U.S. Pat. No. 5,918,859, issued Jul. 6, 1999 to Qian, provides a simple staple remover that has pair of slots in the claws of the jaws for complete removal of a staple with one action, avoiding one leg of the staple remaining in the object while the other leg is dislodged.

While a number of patents provide staple gripping mean on the same side as the staple pulling teeth, the first four patents provide the staple gripping means on the other side of the pivot. The first two patents (U.S. Pat. No. 5,090,662 issued to Koo and U.S. Pat. No. 5,292,106 issued to Li) have a staple puller on one side and a staple gripper on the other side of the pivot to grab a partially removed staple. In both of these patents, the extending arm on the opposite side of the pivot from the staple pulling teeth has a cross member between the side walls of the device and both rely on the finger hold at the staple pulling teeth end to operate the staple gripping end as well.

What is needed is a double ended staple remover having mating standard long-toothed staple puller heads at one end and an opposite end having a multi-toothed mating plier type head with thin mating, teeth edges to grip partially removed staples with no cross pieces between the edges having the rows of teeth or between the ends of the side walls so that the teeth may grip a partially removed staple cleanly between the mating rows of teeth with no cross pieces to interfere with the gripping and having the plier end operable at the plier end itself to exert maximum force on the rows of teeth in gripping the partially removed staples.

SUMMARY OF THE DESCRIPTION

An object of the present invention is to provide a double ended staple remover that has mating standard long-toothed staple puller heads at one end and an opposite end that has a multi-toothed mating plier type head with thin mating teeth edges to grip partially removed staples with no cross pieces between the edges that have the rows of teeth or between the ends of the side walls so that the teeth may grip a partially removed staple cleanly between the mating rows of teeth with no cross pieces to interfere with the gripping and having the plier end operable at the plier end itself to exert maximum force on the rows of teeth in gripping the partially removed staples.

Another object of the present invention is to provide finger grips at the gripping end that are helpful for exerting maximum force and imparting precise twisting or other movements necessary to remove the staple cleanly with a minimum of damage to the paper.

One more object of the present invention is to provide a second gripping end that does not have a cross piece between the channel sides to get in the way of admitting the various oddly shaped partially removed staples between the open channels so that the mating serrated teeth edges of the channels can grip of portion of any partially removed staple for complete removal.

An additional object of the present invention is to provide a double ended staple remover that is easily manufactured by using progressive dies and an injection molding process in which one complete cycle of the tool will yield a full set (or multiple sets at mass production volumes) of components.

In brief, a double ended staple remover and plier device, which completely removes staples from stapled sheets of paper or other material. The device comprises a pair of mating arms that face each other, which are interconnected by a pivot means. Each of the mating arms are formed of steel and comprise an elongated rigid shaft that has a first end structured in a square U-shaped channel from an outer end along a portion of the length of the shaft. The square U-shaped channel has two side walls interconnected by a cross wall along the portion of the length of the shaft. The first end of the mating arm has an elongated tapered tooth at an outer edge of each of the side walls. The elongated tapered tooth arches downwardly from the cross wall and inwardly away from the outer edge of each of the two side walls. The elongated tapered tooth has a sharp point, which gradually widens out to a broad portion where the tooth meets the side wall.

Each of the pair of mating arms has a first finger grip element formed of molded synthetic material, which is on an outer face of the cross wall adjacent to the outer end. One of the mating arms is structured to fit inside of the other of the arms so that with the arms pivotally interconnected the first ends are biased apart and two first finger grip elements can be pressed toward each other to enable the points of the elongated tapered teeth to be inserted into a staple, which is stapled closed to hold together sheets of material. The two mating arms can be squeezed together at the first end to open the staple and can pull a staple out of the material.

The elongated rigid shaft has a second end formed by an extension of the two side walls of the first end but not the cross wall. The two side walls are spaced apart at the second end. Each of the side walls has a row of teeth along an edge of the side wall adjacent to the second end on an opposite edge of the side walls to the edge having the single elongated teeth at the first end. The rows of teeth of one of the mating arms can engage the rows of teeth of the other of the mating arms. The second end has a second finger grip element formed of molded synthetic material, which is across the two side walls along the edge of each side wall opposite to the row of teeth adjacent to edge of the second end. Since the two mating arms are pivotally interconnected, the two second finger grips can be pressed toward each other to bring the rows of teeth on each of the mating arms together to grasp a partially removed staple between the teeth for removing the staple.

The double ended staple remover and plier device also comprises a spring loaded pivot means that interconnects the two mating arms at a point between the first and second ends so that the first and second ends of the mating arms are normally biased apart. Each of the mating arms has aligned openings through each of the side walls midway between the first end and the second end. A pivot pin is secured through the openings to pivotally interconnect the two mating arms and further comprises a spiral spring around the pivot pin with elongated ends that contact the mating arms so that the mating arms are normally biased apart.

The present invention was designed for maximum functionality but with ease of manufacturing in mind. The two key metal members that form the scissor action are made using progressive dies. Every cycle of the die, once the tool is set up, will yield a completed steel member. Two progressive dies are required because the two members are slightly different in widths. The injected molded plastic finger gripping devices are to be made in a family mold where again one complete cycle of the tool will yield a full set (or multiple sets at mass production volumes) of plastic components. All metal components will be plated to a commercially acceptable standard. Further, all components were also designed for ease of final assembly.

An advantage of the present invention is that it provides pliers on one end for gripping a partially removed staple to pull it out.

Another advantage of the present invention is that it provides finger gripping surfaces on the plier end.

An additional advantage of the present invention is that there is no obstruction, such as a cross member between the side walls of the device.

Yet another advantage of the present invention is that it is inexpensive and easy to manufacture.

A further advantage of the present invention is that it is easy to assemble.

Still another advantage of the present invention is that it is a combination tool, thereby lessening clutter in the workplace.

One more advantage of the present invention is that it is easy to use.

A final advantage of the present invention is that it fully removes staples with minimal damage to the paper or material.

BRIEF DESCRIPTION OF THE INVENTION

These and other details of my invention will be described in connection with the accompanying drawings, which are furnished only by way of illustration and not in limitation of the invention, and in which drawings.

BEST MODE FOR CARRYING OUT THE INVENTION

Figure 1:
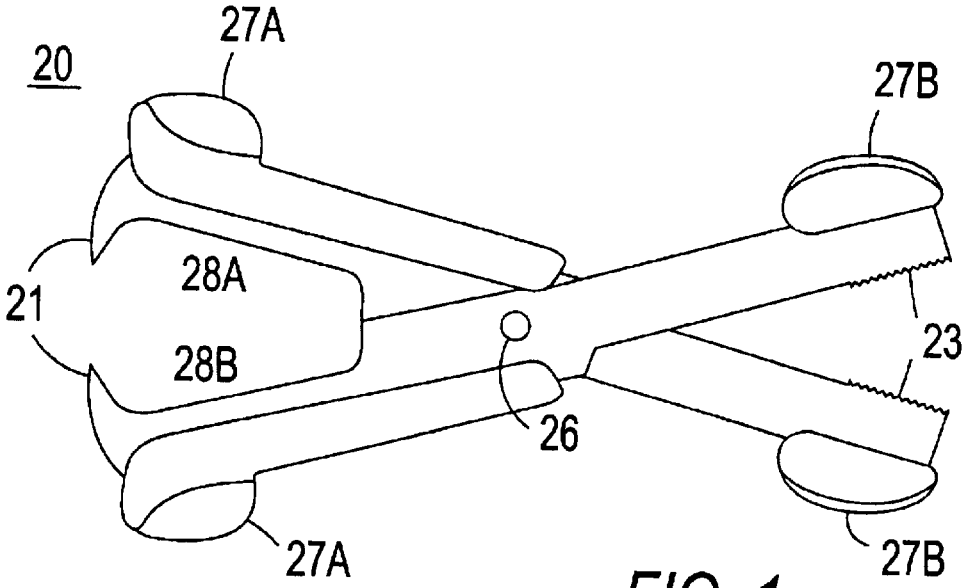
FIG. 1 is a side elevational view of the double ended staple remover/pliers of the present invention showing the two identical arms facing and pivotally connected together.
Figure 2:
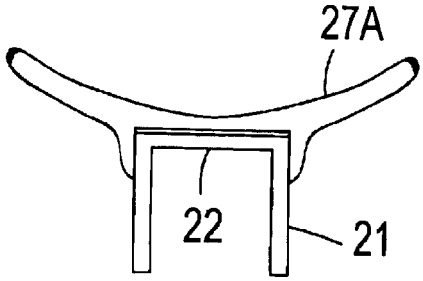
FIG. 2 is an end view of the large paired-tooth traditional staple remover jaws of the invention of FIG. 1.
Figure 3:
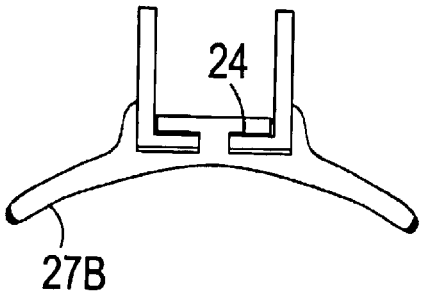
FIG. 3 is an end view of the small multi-toothed pliers jaws of the invention of FIG. 1.
Figure 4:
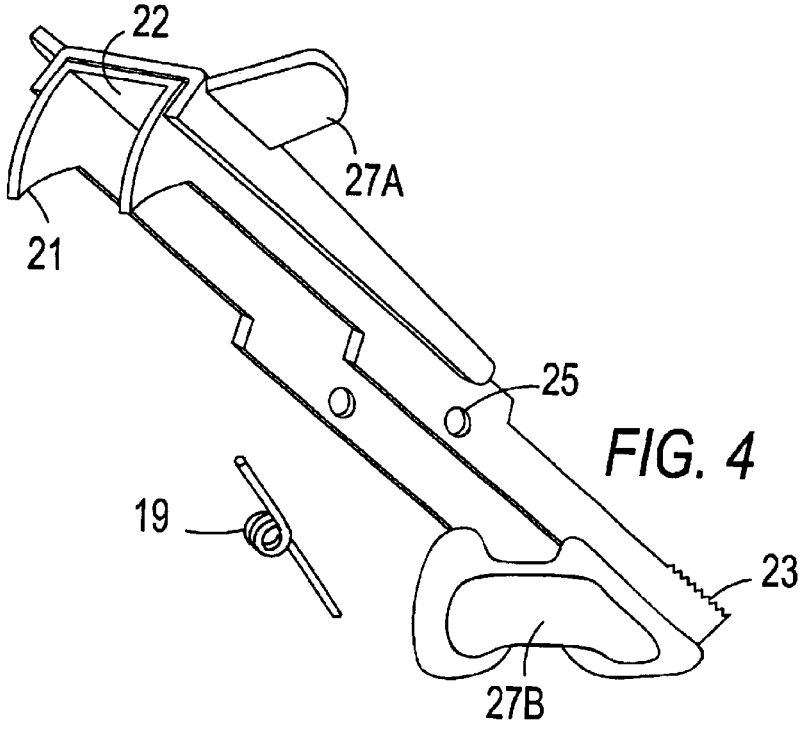
FIG. 4 is a perspective view of one of the two identical arms of the invention of FIG. 1 including the finger grips.
Figure 5:
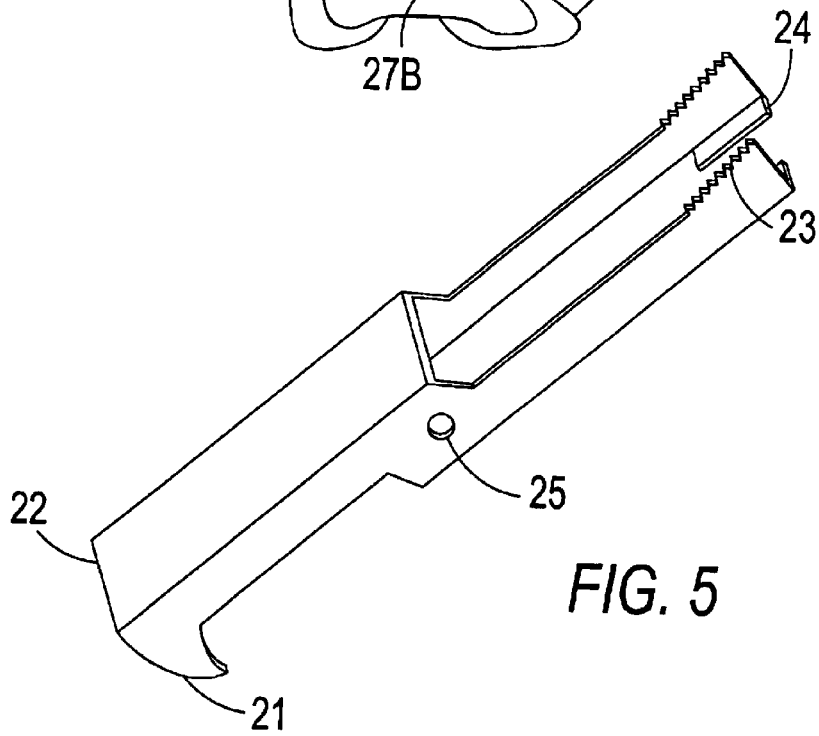
FIG. 5 is a perspective view of one of the two identical arms of the invention of FIG. 1 without the finger grips.

In FIGS. 1–5, a double ended staple remover and plier device 20 for completely removing staples from stapled sheets of paper or other material comprises a pair of mating arms 28A and 28B that face each other, which are interconnected by a pivot means 26, as shown in FIG. 1. Each of the mating arms 28A and 28B are formed of steel and comprise an elongated rigid shaft that has a first end structured in a square U-shaped channel from an outer end along a portion of the length of the shaft. The square U-shaped channel has two side walls interconnected by a cross wall 22 along the portion of the length of the shaft, as shown in FIGS. 2 and 5. The first end of the mating arm 28A and 28B has an elongated tapered tooth 21 at an outer edge of each of the side walls, as shown in FIGS. 1, 4 and 5. The elongated tapered tooth 21 arches downwardly from the cross wall 22 and inwardly away from the outer edge of each of the two side walls. The elongated tapered tooth 21 has a sharp point, which gradually widens out to a broad portion where the tooth meets the side wall, as shown in FIGS. 1, 4 and 5. Each of the pair of mating arms 28A and 28B has a first finger grip element 27A formed of molded synthetic material, which is on an outer face of the cross wall 22 adjacent to the outer end, as shown in FIG. 2. One of the mating arms 28A is structured to fit inside of the other of the arms 28B so that with the arms 28A and 28B pivotally interconnected the first ends are biased apart and two first finger grip elements 27A can be pressed toward each other to enable the points of the elongated tapered teeth 21 to be inserted into a staple, which is stapled closed to hold together sheets of material (not shown). The two mating arms 28A and 28B can be squeezed together at the first end to open and pull a staple out of the material.

The elongated-rigid shaft has a second end formed by an extension of the two side walls of the first end but not the cross wall 22. The two side walls are spaced apart at the second end, as shown in FIGS. 3 and 5. Each of the side walls has a row of teeth 23 along an edge of the side wall adjacent to the second end on an opposite edge of the side walls to the edge having the single elongated teeth 21 at the first end. The rows of teeth 23 of one of the mating arms 28A can engage the rows of teeth 23 of the other of the mating arms 28B. The second end has a second finger grip element 27B formed of molded synthetic material, which is across the two side walls along the edge of each side wall opposite to the row of teeth 23 adjacent to edge of the second end, as shown in FIGS. 1, 3 and 4. Since the two mating arms 28A and 28B are pivotally interconnected, the two second finger grips 27B can be pressed toward each other to bring the rows of teeth 23 on each of the mating arms 28A and 28B together to grasp a partially removed staple between the teeth 23 and pull to fully remove the staple.

The double ended staple remover and plier device 20 also comprises a spring loaded pivot means that interconnects the two mating arms 28A and 28B at a point between the first and second ends so that the first and second ends of the mating arms 28A and 28B are normally biased apart. Each of the mating arms 28A and 28B has aligned openings 25 through each of the side walls midway between the first end and the second end, as shown in FIGS. 4 and 5. A pivot pin 26, shown in FIG. 1, is secured through the openings 25 to pivotally interconnect the two mating arms 28A and 28B and further comprises a spiral spring 19, shown in FIG. 4, around the pivot pin 26 with elongated ends that contact the mating arms 28A and 28B so that the mating arms 28A and 28B are normally biased apart, as shown in FIG. 1.

During the manufacturing process, the two metal mating arms 28A and 28B that form the scissor action are made using progressive dies. Every cycle of the die, once the tool is set up, will yield a completed steel member 28A or 28B. Two progressive dies are required because the two mating arms 28A and 28B are slightly different in widths. The injected molded plastic finger gripping devices 27A and 27B are to be made in a family mold where again one complete cycle of the tool will yield a full set (or multiple sets at mass production volumes) of plastic components. All metal components will be plated to a commercially acceptable standard.

In practice a user would press the two first finger grip elements 27A toward each other to enable the points of the elongated tapered teeth 21 to be inserted into a staple, which is holding together sheets of material. By further pressing on the two first finger grip elements 27A the two mating arms 28A and 28B can be squeezed together to open and pull a staple out of the material. If the staple is not fully removed from the sheets of material, the user may then turn the device 20 around and press the two second finger grips 27B toward each other to bring the rows of teeth 23 on each of the mating arms 28A and 28B together to grasp the partially removed staple. The staple may then be fully removed by exerting force on the two second finger grips 27B and pulling and possibly imparting twisting or other movements necessary to remove the staple cleanly with a minimum of damage to the paper.

It is understood that the preceding description is given merely by way of illustration and not in limitation of the invention and that various modifications may be made thereto without departing from the spirit of the invention as claimed.

What is claimed is:

1. A double ended staple remover and plier device for completely removing staples from stapled sheets of paper, the device comprising:

a pair of mating arms facing each other capable of being interconnected by a pivot means, each of the mating arms comprising an elongated rigid shaft having a first end structured in a square U-shaped channel from an outer end along a portion of the length of the shaft, the square U-shaped channel having two side walls interconnected by a cross wall along the portion of the length of the shaft, the first end having an elongated tapered tooth at an outer edge of each of the side walls, the elongated tapered tooth arched downwardly from the cross wall and inwardly away from the outer edge of each of the two side walls, the elongated tapered tooth having a sharp point gradually widening out to a broad portion where the tooth meets the side wall, each of the pair of mating arms having a first finger grip element on an outer face of the cross wall adjacent to the outer end, one of the mating arms structured to fit inside of the other of the arms so that with the arms pivotally interconnected the first ends are biased apart and two first finger grip elements are capable of being pressed toward each other to enable the points of the elongated tapered teeth to be inserted into a staple which is stapled closed to hold together sheets of a material and the two mating arms capable of being squeezed together at the first end to open the staple and capable of pulling at least one side of the staple out of the material, the elongated rigid shaft having a second end formed by an extension of the two side walls of the first end but not the cross wall, the two side walls spaced apart at the second end with each of the side walls having a row of teeth along an edge of the side wall adjacent to the second end on an opposite edge of the side walls to the edge having the single elongated teeth at the first end, the rows of teeth of one of the mating arms capable of engaging the rows of teeth of the other of the mating arms, the second end having a second finger grip element across the two side walls along the edge of each side wall opposite to the row of teeth adjacent to edge of the second end so that, with the two mating arms pivotally interconnected, the two second finger grips are capable of being pressed toward each other to bring the rows of teeth on each of the mating arms together to grasp a partially removed staple between the teeth for removing the staple;

a spring loaded pivot means capable of interconnecting the two mating arms at a point between the first and second ends so that the first and second ends of the mating arms are normally biased apart.

2. The device of claim 1 wherein the mating arms are formed of steel.

3. The device of claim 1 wherein the finger grips are formed of molded synthetic material.

4. The device of claim 1 wherein each of the mating arms is provided with aligned openings through each of the side walls midway between the first end and the second end and further comprising a pivot pin secured through the openings to pivotally interconnect the two mating arms and further comprising a spiral spring around the pivot pin with elongated ends contacting the mating arms so that the mating arms are normally biased apart.

* * * * *